United States Patent [19]

Leeuwrik

[11] 4,230,648

[45] Oct. 28, 1980

[54] ROTOR ADAPTED TO ROTATE ABOUT A ROTARY SHAFT

[75] Inventor: Frederik H. Leeuwrik, Lochem, Netherlands

[73] Assignee: Nederlandse Organisatie voor Toegepast Natuurwetenschappelijk Onderzcek Ten Behoeve Van Nijverheid, Handel en Verkeer (Nijverheidsorganisatie T.N.O.), The Hague, Netherlands

[21] Appl. No.: 735,453

[22] Filed: Oct. 26, 1976

Related U.S. Application Data

[63] Continuation of Ser. No. 499,298, Aug. 21, 1974, abandoned.

[30] Foreign Application Priority Data

Aug. 22, 1973 [NL] Netherlands ..... 7311537

[51] Int. Cl.[2] ..... B01F 3/04

[52] U.S. Cl. ..... 261/87; 261/93; 261/157; 261/DIG. 75; 366/64; 366/102; 416/176; 416/234

[58] Field of Search ..... 261/83, 84, 87, 91, 261/93, 157, DIG. 75; 259/7, 8, 107, 108; 415/72, 110; 416/84, 176, 177, 198, 200, 207, 210, 242, 234; 417/71; 366/64, 102

[56] References Cited

U.S. PATENT DOCUMENTS

| | | | |
|---|---|---|---|
| 833,850 | 10/1906 | Smith | 416/234 |
| 925,265 | 6/1909 | Balog | 416/234 |
| 1,015,540 | 1/1912 | Butow | 416/176 |
| 1,593,942 | 7/1926 | Lipari | 416/198 |
| 2,063,301 | 12/1936 | Durdin, Jr. | 261/83 |
| 2,151,939 | 3/1939 | Richardson | 416/234 |
| 3,490,996 | 1/1970 | Kelly, Jr. | 261/93 |
| 3,521,864 | 7/1970 | Welles, Jr. | 261/93 X |
| 3,602,604 | 8/1971 | Ronellenfitch | 416/176 X |
| 3,782,702 | 1/1974 | King | 261/87 |
| 3,807,708 | 4/1974 | Jones | 261/93 X |

FOREIGN PATENT DOCUMENTS

| | | | |
|---|---|---|---|
| 4298 | of 1880 | United Kingdom | 416/177 |
| 124647 | 4/1919 | United Kingdom | 416/176 |
| 758190 | 10/1956 | United Kingdom | 416/176 |

*Primary Examiner*—Richard L. Chiesa

*Attorney, Agent, or Firm*—Wegner, Stellman, McCord, Wiles & Wood

[57] ABSTRACT

A rotor adapted to rotate about a rotary shaft and intended for displacing fluids characterized in that the rotor comprises at least two ridges arranged helically around a core part so that a sectional area at right angles to the axis of rotation comprises at least two lobes with intermediate pits, the depth of the pit measured between the core part and a tangential line to the two lobes one on each side of the pit concerned being at least equal to one third of the distance between the core part and the circle described by the point of a lobe furthest remote from the axis of rotation.

6 Claims, 4 Drawing Figures

ROTOR ADAPTED TO ROTATE ABOUT A ROTARY SHAFT

This is a continuation, of application Ser. No. 499,298 filed Aug. 21, 1974, now abandoned.

The invention relates to a rotor adapted to rotate about a rotary shaft and intended for the displacement of fluids.

Such a rotor may be employed both as a propulsion member for vessels and for stirring a quantity of fluid with a stationary disposition of the rotor.

The most conventional member for propelling a vessel is formed by the classical ship's propeller which has now been in use for many decades and which is mainly constituted by a plurality of blades extending outwardly away from a hub.

The rotor according to the invention, on the contrary, is provided with at least two ridges arranged helically around a core part so that a section at right angles to the axis of rotation comprises at least two lobes with intermediate pits, the depth of the pit measured between the core part and a tangential line to the two lobes on either side of said pit being at least equal to one third of the distance between the core part and the circle described by the point of a lobe furthest remote from the axis of rotation.

It has been found that, when such a rotor is caused to rotate in a fluid, an eddy is produced on the lee-side of the ends of the ridges or lobes and will not be released with a given choice of the shape of the lobes and pits so that the pit between two successive lobes is filled with a coherent, rotating fluid mass.

The propelling effect of the rotor embodying the invention is due to the helical course of the ridges around the axis of rotation of the rotor so that the fluid is displaced in an axial direction between the ridges so that there are produced so to say a number of eddy currents travelling at least substantially parallel to the axis of rotation of the rotor corresponding with the number of pits. As a result the rotor is subjected to a force exerted in an axial direction and the fluid is subjected to a reactive force exerted in the opposite direction. The fluid is accelerated by the force exerted thereon in an axial direction, fluid being sucked into the pits in a radial direction and fluid being pushed away by the rotor in an axial direction. The resultant current pattern is therefore completely different from that produced by a conventional ship's propeller and for this reason the use of a tube surrounding the rotor in order to increase the efficiency of the normal ship's propeller is, in general, not desired in this case. It is furthermore found that the whirls occur in a very wide range of circumferential speeds, whilst very high circumferential speeds may be effectively utilized without the risk of any harmful cavitation.

The rotor according to the invention can be effectively employed not only as a propulsion member for a vessel but it also constitutes a particularly efficacious member for introducing a gas, for example, air into a fluid it being thus possible to obtain a very intimate mixture of large quantities of gas with the fluid. The gas is sucked in by the subatmospheric pressure produced by the jet behind the rotor so that the introduction of the gas does not require additional energy.

The invention will now be described more fully hereinafter with reference to an embodiment of a rotor in accordance with the invention illustrated in the accompanying Figures and to a few potential applications of such a rotor shown in the Figures.

FIG. 5 is a sectional view taken substantially along the line 5—5 of FIG. 1.

Figure 2:
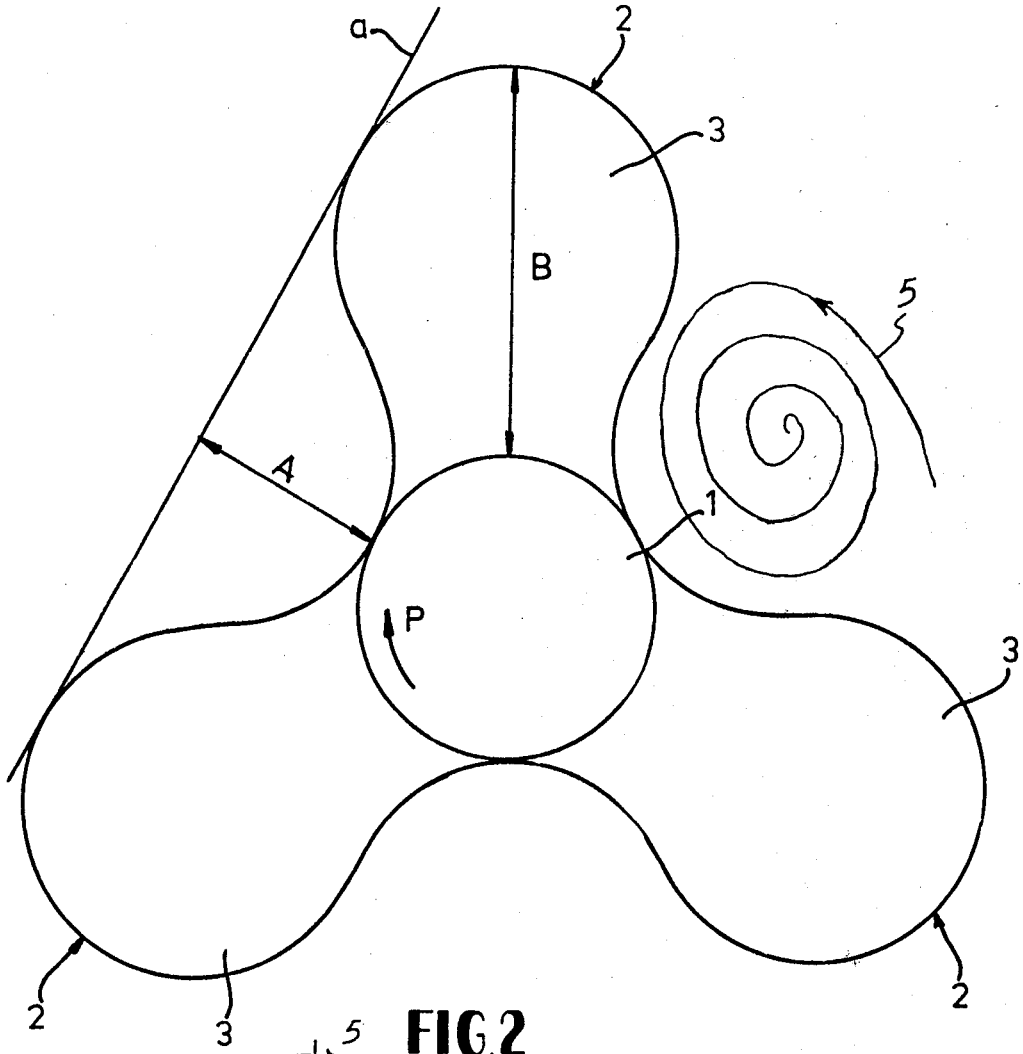
FIG. 2 is an enlarged schematic sectional view of the rotor shown in FIG. 1.
Figure 1:
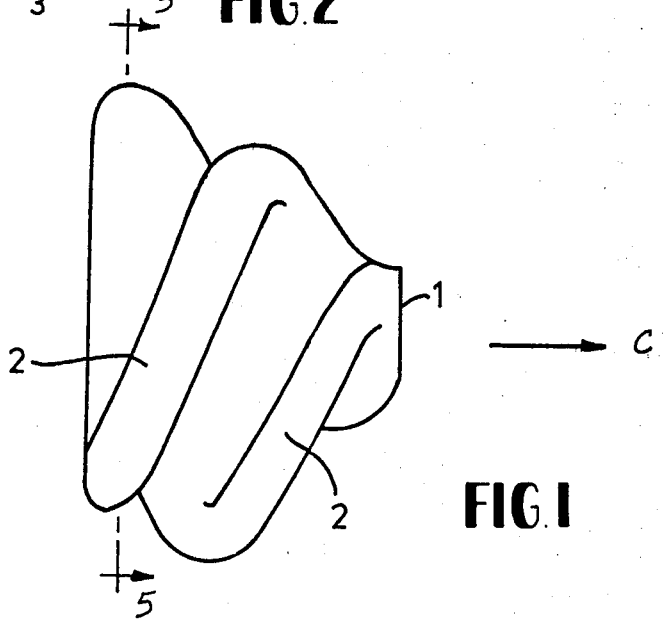
FIG. 1 is an elevation of a rotor in accordance with the invention.

The rotor according to the invention shown in FIGS. 1 and 2 comprises a cylindrical core part 1, which is integral with three ridges 2 helically surrounding the core part. The ridges are rounded off at the tops and at the transitions into the core 1 so that in a sectional view (FIGS. 2 and 5) the rotor has a continuous, uniformly curved circumference, the sectional area of the rotor having the core part 1 and three uniformly spaced lobes 3 projecting radially outwards. The boundary lines of the pits and of the ends of the lobes 3 are mainly formed by circular lines. The depth of a pit located between two lobes 3, that is to say, the distance A between the tangential line a to the lobes 3 on either side of the pit is at least substantially equal to one third of the distance B between the core part 1 and the circle described by the point of a lobe 2 furthest remote from the axis of rotation. The radius of curvature of the boundary line of the end of a lobe is preferably at least one third of the distance B so that a gradual course of the lobe is obtained, which is necessary for the production of the eddy current aimed at. The radius of the boundary line of a pit is preferably approximately equal to the radius of curvature of the boundary line of the lobes located on either side of the pits concerned.

An advantageous embodiment is obtained by using three ridges with a depth A of the pit approximately equal to half the aforesaid distance B.

FIG. 2 shows schematically in one of the pits the current pattern produced therein, when the rotor is rotating in the direction of the arrow P. This current pattern is characterized by a coherent whirl 5, the centre of which is located eccentrically with respect to the centre of the pit. Viewed in the direction of rotation of the rotor a comparatively high speed and a comparatively low pressure are produced on the rear side of each lobe near the surface thereof, whereas on the leading side of the lobe the fluid has a lower speed and the pressure on the relevant surface of the lobe is higher.

In practice it has been found that, when a rotor in accordance with the invention is employed as a propulsion member for a vessel, the efficiency of the drive is certainly at least substantially equal to, if not higher than the efficiency of the drive of a ship's propeller. Besides the rotor in accordance with the invention has some few essential advantages over the use of a conventional ship's propeller. It is generally known, for example, that a classical ship's propeller can be the cause of serious injury when one comes into contact with such a propeller. This danger is practically absent when a rotor according to the invention is used.

A further advantage resides in that at a reversal of the direction of the rotor its braking effect is materially better than that of a conventional propeller, whilst the propulsive power in both directions is substantially the same.

Figure 3:
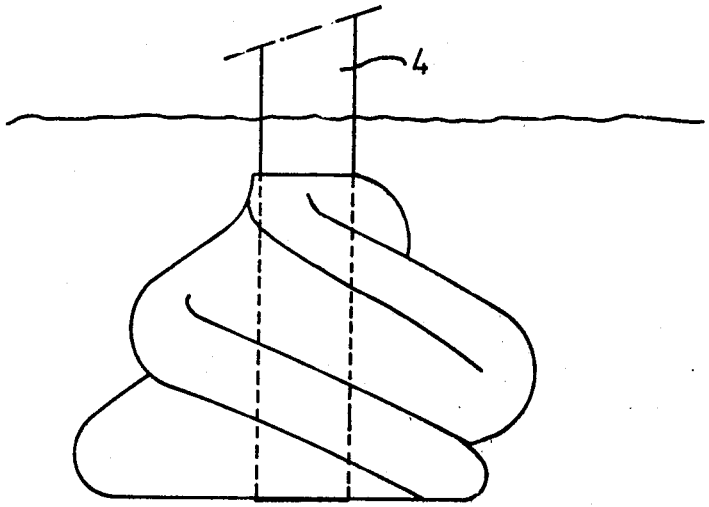
FIG. 3 illustrates the disposition of a rotor for introducing air into a fluid.

Although the rotor in accordance with the invention may be constructed in a cylindrical shape, it is particularly effective to provide a tapering shape of the rotor as is shown in FIG. 1. With such a tapering shape there is substantially no risk of foreign material sticking to the rotor so that the rotor may be employed in a highly contaminated fluid without giving rise to difficulties. The normal advancing movement of the rotor, when used as a propulsion member for a vessel is in the direction of the arrow C. The rotor in accordance with the invention is not only particularly suitable for propelling vessels, but it may also be effectively employed for stirring a quantity of fluid, for example, in agitating processes in which, as the case may be, simultaneously gas, for example, air is introduced into the fluid. The latter may be of particular inportance in water purifying systems and the like. A particularly effective arrangement for this purpose is illustrated in FIG. 3.

In this embodiment the core of the rotor is hollow and a hollow shaft 4 is secured to the hollow core, openings being provided in said shaft above the level of the fluid. It will be obvious that although in FIG. 3 the axis of rotation of the rotor is shown in a vertical position, the axis of rotation may be arranged at an angle of horizontally in dependence upon the system in which the rotor is arranged and on the purpose aimed at, care being taken for the hollow shaft 4 joining the hollow core of the rotor to communicate with the open air or another source of gas to be introduced into the fluid.

When the rotor is caused to rotate, the current pattern described above will be produced and the moving water sucks on air via the shaft 4, said air being finely divided and intimately mixed with the water by the whirls produced in the pits of the rotor and with a vertical disposition in a container or the like the air is pushed down to a great depth in the fluid mass in the container. Since, when viewed in the direction of flow of the fluid, the air is first supplied from behind the rotor, the air feed will not adversely affect the operation of the propulsion member.

Figure 4:
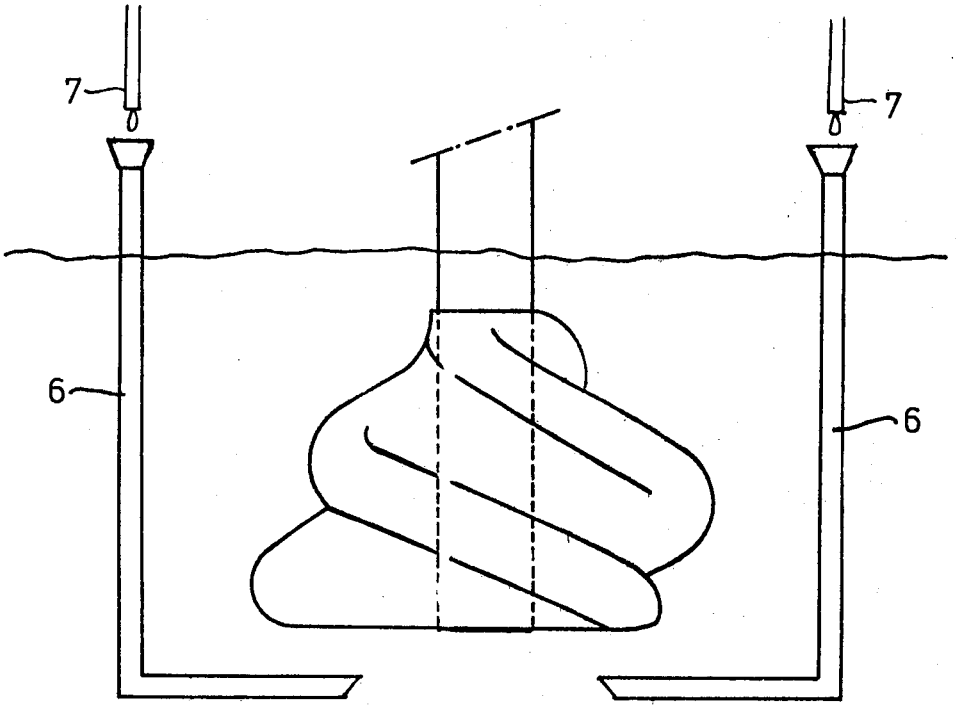
FIG. 4 shows the disposition of a rotor in conjunction with means for heating the fluid in which the rotor is arranged.

Instead of feeding the air through the hollow core of the rotor, one or more ducts 6, as shown in FIG. 4, and being in open communication with the open air or with a different source of gas may be arranged so that the end of the duct 6 located below the water level is located, viewed in the direction of displacement of the water by the rotor, behind the rotor and preferably slightly eccentrically with the respect to the centre line of the rotor. The water displaced by the rotor will produce at the end of the duct a subatmospheric pressure so that air or a different gas is sucked on and carried along by the whirls produced and intimately mixed in a finely divided state with the water. By arranging burners 7 near the supply openings of the ducts 6 the gas (air) sucked on can be heated so that the fluid can be heated as well with the aid of this hot gas. It is particularly effective to arrange a gas burner so that the flame is produced in or in front of the mouth of the air supply duct 6 so that the thermal energy supplied is completely transferred to the water. An effective application is found, for example, in heating swimming pools, in which hot air is introduced into the water, which is thus heated, whilst at the same time the rotor produces a circulation in the water, the water heated near the rotor being thus pushed around in the pool.

As a matter of course, the supply of air described above can be carried out not only with a stationary disposition of the rotor, for example, in the aerating ditch of a water purifying system, but this supply of air may also be employed when the rotor is used for propelling a vessel without the propulsive power of the rotor being adversely affected. It is thus possible to achieve aeration of the surface water with the aid of vessels passing through the water.

The supply of air described could, of course, also be employed with conventional propellers, but the rotor in accordance with the invention will provide a considerably better mixing of the air owing to the eddy currents produced in the water by the rotor.

If necessary, the gas(air) may be supplied at a higher pressure, for example, by arranging a blower in the suction duct so that a still greater quantity of gas (air) can be introduced into the fluid.

The rotor is not only particularly suitable for introducing a gas into a fluid, but may also be employed successfully for uniformly mixing two or more liquids or one more liquids with a powdery of granular material. When the fluids to be mixed of the fluid(s) to be mixed and the powder and/or granular material are put in a vessel and subsequently the contents of the vessel are agitated with the aid of the rotor or when one or more of the substances are introduced into a vessel already containing a fluid in the manner described above for the introduction of a gas into a fluid whilst the rotor is rotating, the eddy currents produced a highly intensive and uniform mixing of the various constituents in the vessel or the like.

What we claim is:

1. A rotor having a core part adapted to be rotated about an axis of rotation for displacing fluids, said core part carrying at least three continuous uniformly curved symmetrically-shaped helical ridges defining a continuous three-lobe cross section in radial planes along the length of the core part, said ridges defining three intermediate pits, said ridges blending into the core part to have the innermost portion of the pits coincident with the core part, the depths of each of the pits measured between the core part and a tangential line to two of said lobes, one on each side of the pit concerned, being at least equal to one-third of the distance between the core part and the maximum radius of said ridges, each of the three lobes in each radial section of the rotor being uniformly curved and symmetrical about a radius from the axis of the rotor to the distal point of the lobe and each of the three pits intermediate the lobes being uniformly curved and symmetrical about a radius from the axis of the rotor to the radially innermost part of the pit.

2. A rotor as claimed in claim 1 characterized in that the depth of the pit is approximately equal to half the distance between the core part and the circle described by the point of a lobe furthest remote from the axis of rotation.

3. A rotor as claimed in claim 1, characterized in that the rotor has a longitudinally tapering shape.

4. A rotor as claimed in claim 1 characterized in that the free ends of the lobes are bounded by at least substantially circular lines which gradually terminate reversely in at least substantially circular lines forming the boundaries of the pits.

5. A rotor as claimed in claim 4, characterized in that the radius of curvature of a boundary line of a lobe is at least one third of the distance between the core part and the circle described by the point of a lobe furthest remote from the axis of rotation.

6. A rotor as claimed in claim 4 characterized in that the radii of curvature of the boundary line of the free ends of the lobes are at least substantially equal to each other.

* * * * *